US006865860B2

(12) United States Patent
Arakawa et al.

(10) Patent No.: US 6,865,860 B2
(45) Date of Patent: Mar. 15, 2005

(54) FORM-FILL SEALING MACHINES, RESEALABLE FLEXIBLE PACKAGES AND METHODS OF MANUFACTURING RESEALABLE FLEXIBLE PACKAGES

(75) Inventors: Masaki Arakawa, Nagoya (JP); Takeo Matsui, Nagoya (JP)

(73) Assignee: Fuji Machinery Co., Ltd., Aichi-Ken (JP)

( * ) Notice: Subject to any disclaimer, the term of this patent is extended or adjusted under 35 U.S.C. 154(b) by 0 days.

(21) Appl. No.: 10/403,756

(22) Filed: Mar. 31, 2003

(65) Prior Publication Data

US 2004/0011677 A1 Jan. 22, 2004

(51) Int. Cl.[7] ..... B65B 9/20; B65B 61/18

(52) U.S. Cl. ..... 53/412; 53/415; 53/451; 53/133.8; 53/135.3; 53/551

(58) Field of Search ..... 53/412, 415, 451, 53/133.8, 135.3, 551; 383/66

(56) References Cited

U.S. PATENT DOCUMENTS

| | | | | |
|---|---|---|---|---|
| 3,471,351 A | * | 10/1969 | Fuchs | 53/135.3 |
| 4,610,357 A | | 9/1986 | Nakamura | 206/449 |
| 4,653,250 A | * | 3/1987 | Nakamura | 53/412 |
| 4,709,399 A | * | 11/1987 | Sanders | 383/66 |
| 5,161,350 A | * | 11/1992 | Nakamura | 53/412 |
| 5,439,102 A | * | 8/1995 | Brown et al. | 206/63.3 |
| 6,026,953 A | | 2/2000 | Nakamura et al. | 206/233 |
| 6,041,575 A | * | 3/2000 | Vonderhorst et al. | 53/415 |

FOREIGN PATENT DOCUMENTS

| | | | |
|---|---|---|---|
| DE | 89 07 826 A | 11/1989 | B65D/75/62 |
| DE | 39 33 572 A | 4/1991 | B65D/85/16 |
| EP | 0447 636 A | 9/1991 | B65D/75/58 |
| EP | 1 035 032 A1 | 9/2000 | B65D/75/52 |
| WO | WO 01 98172 A | 12/2001 | B65D/75/58 |

* cited by examiner

*Primary Examiner*—John Sipos
(74) *Attorney, Agent, or Firm*—Conley Rose, P.C.

(57) ABSTRACT

A form-fill sealing machine (1) for manufacturing resealable packages (W) includes a tearable line forming device (30) that serves to form tearable lines (104) in a film (F). A labeling device (40) serves to stick re-stickable labels (103) onto the film in positions to cover respective tearable lines. A tube forming device (60) serves to form the film into a tubular film (T). A first sealing device (80) serves to seal lapped edges of the tubular film so as to form a lengthwise sealed portion (111). A second sealing device (90) serves to seal the tubular film in a crosswise direction, so that crosswise sealed portions (109) are formed on the tubular film. Each tearable line is positioned between two adjacent crosswise sealed portions and adjacent to one of two adjacent crosswise sealed portions.

19 Claims, 6 Drawing Sheets

FORM-FILL SEALING MACHINES, RESEALABLE FLEXIBLE PACKAGES AND METHODS OF MANUFACTURING RESEALABLE FLEXIBLE PACKAGES

This application claims priority to Japanese patent application Ser. No. 2002-183129, the contents of which are incorporated herein by reference.

BACKGROUND OF THE INVENTION

1. Technical Field

The present invention relates to form-fill sealing machines that are adapted to form packages, in particular, resealable packages that are suitable for containing a number of separate articles, e.g., candies, chocolates, grilled bits of rice cake, or any other confectionery products. The present invention also relates to packages formed by such form-fill machines and methods of manufacturing the packages.

2. Description of the Related Art

Resealable pillow packages are known that have take-out openings that can be resealed after articles have been taken out from the packages. For example, packages for wet tissues are well known as such resealable pillow packages and this type of resealaable packages are taught, for example, by Japanese Utility Model Publication No. 6-24377.

More specifically, Japanese Utility Model Publication No. 6-24377 teaches a resealable package that has a top wall, in which a substantially U-shaped tearable line is defined. An sheet-like outer cover may be bonded to the upper surface of the top wall of the package by adhesive that can be repeatedly used for bonding. Therefore, when the outer cover is lifted, an inner cover that is defined by a region enclosed by the tearable line is removed from the package together with the outer cover, so that an opening may be formed in the top wall of the package. The opening may permit the articles within the package to be taken out through the opening. The opening may be sealingly closed when the removed outer cover is again bonded to the upper surface of the top wall. Because the opening can be resealed, the remaining articles may be prevented from being exposed to the ambient air and from being desiccated.

In addition, both ends of the tearable line of the package of Japanese Utility Model Publication No. 6-24377 are bifurcated. The bifurcated potions of the tearable line may serve to disperse the pulling force applied to both ends of the tearable line when the inner cover is pulled during the removal of the outer cover. Therefore, the propagation of the tearing beyond both ends of the tearable line can be prevented.

However, if the inner cover has been pulled by a strong force, the bifurcated portions of the tearable line may not resist against the pulling force even if the pulling force has been divided at the bifurcated portions. Therefore, a possibility has existed that the bifurcated portions will not be able to prevent the propagation of the tearing beyond both ends of the tearable line. Thus, if the tearing propagates to extend beyond the bonding area of the outer cover, the sealing property cannot be ensured.

SUMMARY OF THE INVENTION

It is accordingly an object of the present invention to teach improved techniques for reliably preventing the propagation of the tearing beyond tearable lines of resealable packages.

According to one aspect of the present teachings, form-fill sealing machines for manufacturing resealable flexible packages are taught. The form-fill sealing machines may include a tearable line forming device that may serve to form tearable lines in a film. The tearable lines may be spaced from each other by a distance corresponding to a single package length. Each tearable line may have both ends. A labeling device may serve to stick re-stickable labels onto the film in positions to cover respective tearable lines. A tube forming device may serve to form the film into a tubular film. A first sealing device may serve to seal lapped edges of the tubular film so as to form a lengthwise sealed portion. A second sealing device may seal the tubular film in a crosswise direction, so that crosswise sealed portions are formed on the tubular film. Each tearable line may be positioned between two adjacent crosswise sealed portions. Both ends of each tearable line may be disposed adjacent to or intersect one of two adjacent crosswise sealed portions. A cutting device may cut the tubular film at each crosswise sealed portion, so that packages each having crosswise sealed portions on both sides in the longitudinal direction of the packages are formed.

Therefore, even in the event that the label has been peeled off by a strong force from the package, the propagation of the tearing may be reliably stopped at the crosswise sealed portion. Therefore, the sealing property of the package can be reliably maintained even if the package has been repeatedly opened and resealed many times. In addition, the packages having the tearing propagation prevention function can be manufactured one after another.

According to another aspect of the present teachings, resealable flexible packages are taught that may include a hollow package body formed by a film, e.g., heat sealable synthetic resin film. A tearable line may be defined in the package body. The tearable line may be formed by a series of perforations, or may be a cut line that does not extend throughout the thickness of the film. The tearable line may have both ends and defines an inner cover that is surrounded by the tearable line. The tearable line may be torn when the inner cover is pulled toward outside of the package body. A re-stickable label may be stuck onto the package body in order to cover the tearable line. The inner cover may be pulled together with the label as the label is peeled off from the package body in a peeling direction. A sealed portion may be disposed adjacent to both ends of the tearable line so as to seal the package. The sealed portion may extend in a direction that intersects with the direction of propagation of the tearing of the tearable line.

Therefore, even in the event that the label has been peeled off by a strong force, the propagation of the tearing may be reliably stopped at the sealed portion. Therefore, the sealing property of the package can be reliably maintained even if the package has been repeatedly opened and resealed many times.

In another aspect of the present teachings, the sealed portion may be a crosswise sealed portion. Therefore, the construction of the package may be simplified while the propagation of the tearing may be reliably prevented.

In another aspect of the present teachings, methods of manufacturing a plurality of resealable flexible packages are taught. The packages may be formed by a film. The methods may comprise the following steps:

(1) Forming a plurality of tearable lines in the film. The tearable lines may be spaced from each other by a distance corresponding to a single package length in a longitudinal direction of the film and each of the tearable lines may have first and second ends.

(2) Sticking a plurality of re-stickable labels onto one surface of the web-like film to cover the respective tearable lines.

(3) Forming the film into a tubular film. The labels may be positioned on the outer side of the tubular film.

(4) Sealing lapped edges of the tubular film. The lapped edges may extend in the longitudinal direction of the tubular film;

(5) Sealing the tubular film in a crosswise direction at intervals corresponding to the intervals of the tearable lines, so that crosswise sealed portions are formed on the tubular film.

(6) Cutting the tubular film at each of the crosswise sealed portions, so that a plurality of packages each having first and second sealed ends defined by the crosswise sealed portions are formed. The first and second ends of each package may be positioned adjacent to or intersect with the first sealed end.

Therefore, the packages having the tearing propagation prevention function can be manufactured one after another by using these methods.

Preferably, the step of sealing the tubular film in the crosswise direction and the step of cutting the tubular film are performed simultaneously with each other. Therefore, the manufacturing process can be simplified.

DETAILED DESCRIPTION OF THE INVENTION

Figure 1:
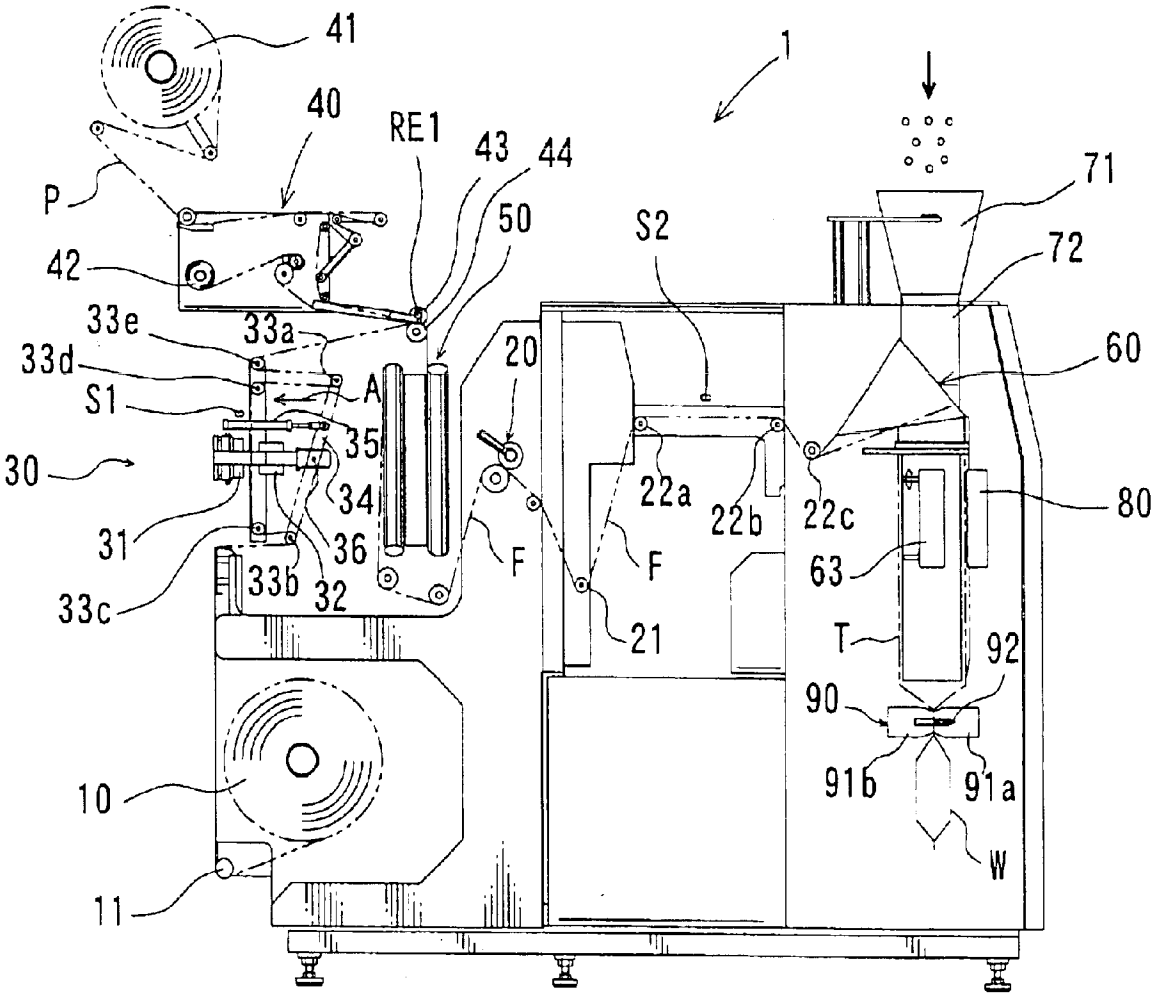
FIG. 1 is a schematic view of a representative vertical form-fill sealing machine.

In one embodiment of the present teachings, form-fill sealing machines are taught that may be adapted to manufacture resealable flexible packages. Each package may include a package body, a tearable line defined in the package body, an inner cover surrounded by the tearable line, and a re-stickable label attached to the package body in order to cover the tearable line. When the label is peeled off, the inner cover may be open to form a take-out opening in the package body, while a first end of the inner cover remains to be stuck onto the package body. Here, the first end of the inner cover may be disposed opposite to a second end of the inner cover that may be pulled up together with the label when the label is peeled off.

The form-fill sealing machines may include a film feeding device, a tearable line forming device, a labeling device, a tube forming device, a lengthwise sealing device and a crosswise sealing device.

The film feeding device may serves to feed a flexible film from a roll of the film. For example, the film feeding device may include a pair of rollers that are rotatably driven by a motor. The film may extend between the rollers, so that the film may be forcibly moved as the rollers rotate.

The tearable line forming device may serve to form the tearable line in film at each time when the web-like film is fed by the film feeding means by a distance that corresponds to a single package length. For example, the tearable line forming device may include a knife and an anvil that can move relative to each other with the film positioned between the knife and the anvil. Preferably, the tearable line may be configured such that the pulling-off direction of the inner cover becomes the same as the feeding direction of the film.

The labeling device may serve to stick the label onto the web-like film so as to cover each tearable line formed in the film.

The tube forming device may serve to form the film into a tubular configuration after the labels have been stuck onto the film.

The lengthwise sealing device may serve to seal lapped edges of the tubular film so as to form a lengthwise sealed portion that extends along a lengthwise direction of the tubular film.

The crosswise sealing device may serve to seal the tubular film to form first and second crosswise sealed portions that extend along a crosswise direction at forward and rearward positions of an article or a group of articles that are charged into the tubular film. The first crosswise sealed portion may extend across the first end of the corresponding label in a position adjacent to intersecting with both ends of the corresponding tearable line.

The resealable flexible packages manufactured by the form-fill sealing machines may reliably prevent the propagation of the tearing of the tearable line beyond both ends of the tearable line. Thus, when the resealable label is peeled off, the inner cover stuck onto the label may be lifted or pulled together with the label. Therefore, the tearable line may be torn, so that the take-out opening is defined. When the label is peeled off by a strong force, the inner cover also may be pulled by a strong force. However, the tearable line may not be torn beyond both ends of the tearable line, because the first crosswise sealed portion is positioned on the virtual lines extending from both ends of the tearable line. In other words, the first crosswise sealed portion may serve as a reinforcing portion that prevents the propagation of the tearing of the tearable line beyond both ends of the tearable line. Preferably, the crosswise sealing device may serve to seal the tubular film by heat, so that the lapped film portions may be melted or fused together to form the first and second crosswise sealed portions. Therefore, the propagation of the tearing can be further reliably prevented In addition, because the first crosswise sealed portion extends across the first end of the label in a position adjacent to both ends of the tearable line or a position intersecting with both ends of the tearable line, the tearing may not propagate to extend outside of the stuck range of the label. Therefore, the sealing performance can be reliably maintained even if the resealing operation has been repeatedly performed many times.

Furthermore, because the take-out opening may be positioned adjacent to the first crosswise sealed portion that may define one end of the package, the article(s) contained within the package may be easily taken out or discharged by positioning a second end opposite to the first end such that the second end is turned upward. This measure is advantageous in particular when the package contains a plurality of separate articles.

In another embodiment of the present teachings, the first crosswise sealed portion may be disposed adjacent to the ends of the tearable line, so that virtual lines extending from the ends of the tearable line intersect with the first crosswise sealed portion.

Therefore, both ends of the tearable line may be spaced from the first crosswise sealed portion by a short distance, while the virtual lines extending from both ends of the tearable line may intersect with the first crosswise sealed portion. Even in the event that the tearing has propagated beyond both ends of the tearable line when the inner cover has been pulled up by a strong force in the peeling direction of the label, the propagation of the tearing may be stopped when the tearing reaches the first crosswise sealed portion. Therefore, the propagation of the tearing may be minimized. In addition, the size of the label to be determined in view of possible propagation of the tearing can be minimized. As a result, the material cost of the labels may be reduced.

In another embodiment of the present teachings, the crosswise sealing device may clamp the first end of the label together with the film n in order to form the first crosswise sealed portion.

Therefore, the label may be reliably stuck onto the package body, because the first end of the label may be pressed against the package body. Preferably, the backside of at least the first end of the label may be treated or coated with a material that can be fused or melted to be adhered onto the package body when the first crosswise sealed portion is clamped to be sealed by heat. Therefore, the first end of the label can be reliably fixed to the package body, so that the label may be prevented from being removed from the package. In addition, it is not necessary to adjust the position of the label when the label is stuck again onto the package to cover the take-out opening. Therefore, the package may be conveniently used.

In another embodiment of the present teachings, the form-fill sealding machines may be vertical form-fill sealing machines, in which the tubular film is fed vertically downward and the article or the articles supplied into the tubular film fall downward within the tubular film. The labeling device may be disposed on the upper side along the feeding path of the film. A film turning device may be disposed along the feeding path of the film between a film sticking position for sticking the labels by the labeling device and the tube forming device. The film turning device may serve to turn the film upside down.

This embodiment may be particularly advantageous if a plurality of separate articles, e.g., candies, chocolates, grilled bits of rice cake, and any other confectionery products, are to be contained within each package. Because the package can be reliably resealed every time after a small amount of the articles have been taken out from the package, the remaining articles within the package can be reliably prevented from becoming moist, so that the quality of the articles can be reliably maintained.

In addition, because of the arrangement of the labeling device on the upper side along the feeding path of the film, the labeling device may be located not to interfere with various elements that are disposed along the feeding path of the film. In addition, the space along the film feeding path can be effectively utilized. Further, because of the arrangement of the film turning device along the feeding path of the film between the label sticking position for sticking the labels and the tube forming device, the labels can be attached to the surface of the film that defines an outer surface of the tubular film formed by the tube forming device. Therefore, the labeling device is not required to be specially designed. Therefore, labeling devices designed for general purpose may be used.

In another embodiment of the present teachings, the form-fill sealing machines may include a mark sensor that detects registration marks affixed to the web film. A signal generating device may generating signals representing a film feeding amount corresponding to the feeding amount of the film. The feeding position of the film may be recognized based on signals from the mark sensor and the signal generating device, so that the position of each tearable line can be determined. Here, the term "feeding position of the film" is used to mean either the feeding position of the film before it is fed to the tube forming machine or the feeding position of the tubular film.

This embodiment may be particularly advantageous when figures or patterns each corresponding to a single package length are printed on the film. Because the determination of the feeding position of the film may be made based on the signals from the mark sensor and the signal generating device, the formation of the tearable lines and the sticking of the labels to cover the tearable lines may be accurately made at suitable positions that may be determined relative to the positions of the figures or the patterns. In addition, the position of the first crosswise sealed portion may be accurately determined such that the crosswise sealed portion extends across the first end of the label and that both ends of the tearable line are positioned on the first crosswise sealed portion or positioned adjacent to the first crosswise sealed portion. As a result, reliably resealable pillow packages can be manufactured.

In another embodiment of the present teachings, resealable flexible packages are taught that may be manufactured by the form-fill machines as described above.

Each of the additional features and teachings disclosed above and below may be utilized separately or in conjunction with other features and teachings to provide improved form-fill sealing machines, releasable flexible packages and methods of manufacturing releasable flexible packages. Representative examples of the present invention, which examples utilize many of these additional features and teachings both separately and in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

A representative vertical form-fill sealing machine 1 will now be described with reference to the drawings. Referring to FIG. 1, the vertical form-fill sealing machine 1 may include a roller 10 for storing a web-like film F, a film feeding device 20, a tearable line forming device 30, a labeling device 40, a film turning device 50, a tube former 60, a lengthwise sealer 80, and a crosswise sealer 90.

The web-like film F may be wound around the roller 10, so that the roller 10 may serve as a supply source of the web-like film F. The film feeding device 20 may include a pair of rollers and may serve to feed the film F that is unwound from the roller 10, so that the film F can be fed toward a downstream side. The tearable line forming device 30 may serve to form tearable lines 104 (see FIGS. 4 and 6) in the film F in positions that are separated from each other by a distance that corresponds to a single package length. The labeling 40 may serve to sticking re-stickable labels 103 (see FIGS. 3, 4 and 6) onto the film F such that the tearable lines 104 are covered by the labels 103. The film turning device 50 may serve as a film reversing device for turning the film F upside down. The tube former 60 may serve to form the film F into a tubular configuration. The film F formed into the tubular configuration will be hereinafter called "tubular film T." The lengthwise sealer 80 may serve to clamp a lapped edge of the tubular film T and to seal the lapped edge in the longitudinal direction, so that a lengthwise sealed portion 111 may be formed on the tubular film T (see FIG. 5). The crosswise sealer 90 may serve to seal the tubular film F in the crosswise direction (i.e. a widthwise direction) in positions on both front and rear sides of each of articles (not shown) that are supplied into the tubular film T. As a result, crosswise sealed portions 109 may be formed on the tubular film F (see FIGS. 3 to 5).

Referring to FIG. 1, the web-like film F may be unwind from the roller 10 and may be continuously fed toward the tearable line forming device 30 toward the downstream side via a guide roller 11. Preferably, the tearable line forming device 30 may include a knife 31 and an anvil 32 that oppose to each other in the horizontal direction so as to interleave the film F. Each time when the film F is fed by a distance corresponding to a single package length, the knife 31 may move toward the anvil 32, so that the tearable lines 104 may be formed in the film F. Preferably, the tearable lines 104 may have a substantially U-shaped configuration and may be perforated lines or half tearable lines. The tearable lines 104 may be torn along the tearable lines 104, so that the portions surrounded by the tearable lines 104 may be pulled out. As a result, take-out openings 106 (see FIG. 3) may be formed as will be hereinafter described.

Preferably, the tearable line forming device 30 may include a pivot lever 34 that can pivot both in forward and rearward directions about a rotary shaft 36. Pulleys 33*a* and 33*b* may be attached to the upper end and the lower end of the pivot lever 34, respectively, and may be free to rotate relative to the pivot lever 34. The pulleys 33*a* and 33*b* may serve to engage the film F after and before the tearable lines 104 are formed in the film F, respectively. Fixed pulleys 33*c* and 33*d* may be disposed to vertically oppose to each other to interleave the knife 31 and the anvil 32.

Thus, the film F unwound from the roller 10 may be first engaged by the pulley 33*b* disposed at the lower end of the pivot lever 34. Then, the film F may engage the fixed pulleys 33*c* and 33*d* so as to be fed vertically upward, while the film F passes through a space between the knife 31 and the anvil 32. Therefore, the tearable lines 104 may be formed in the film F as the film F passes through the space between the knife 31 and the anvil 32. After the tearable lines 104 have been formed, the film F may be engaged by the pulley 33*a* that is disposed at the upper end of the pivot lever 34. Thereafter, the film F may be engaged by the fixed pulley 33*e* so as to be fed toward the labeling device 40 that is disposed above the tearable line forming device 30.

During the time when the film F is clamped between the knife 31 and the anvil in order form the tearable lines 104, the pivot lever 34 may pivot in a direction as indicated by an arrow A in FIG. 1. Thus, as the rollers of the film feeding device 20 rotate to feed the film F, a portion of the film F that is engaged by the upper pulley 33*a* may be paid out toward the downstream side. After each time the tearable line 104 has been formed, the film F may be released from the clamped state between the knife 31 and the anvil 32. Then, the pivot lever 34 may pivot in a direction opposite to the direction indicated by the arrow A, so that the pivot lever 34 returns to the original position. Therefore, the film F may be continuously fed from the tearable line forming device 30 toward the downstream side without interruption even when the film F is clamped between the knife 31 and the anvil 32.

The labeling device 40 may be disposed on the downstream side of the tearable line forming device 30 and may be positioned above the tearable line forming device 30. The labeling device 40 may serve to peel off labels 103 one by one from a paper P coated with a release agent (hereinafter called "release paper P") and also serves to stick the peeled labels 103 onto the film F in positions to cover the tearable lines 104. Because labeling devices that may perform these operations are well known, detailed description of the labeling device 40 will not be necessary. The release paper P with the labels 103 attached thereto may be wound about a label supply roller 41 so as to be set thereon. After the labels 103 have been peeled off, the release paper P may be wound about an unwind roller 42 so as to be recovered.

The film turning device 50 may be disposed on the upstream side of the film feeding device 20 along the film feeding path extending between a label sticking position of the labeling device 40 and the tube former 60. The film turning device 50 may serve to turn the film F upside down.

Figure 2:
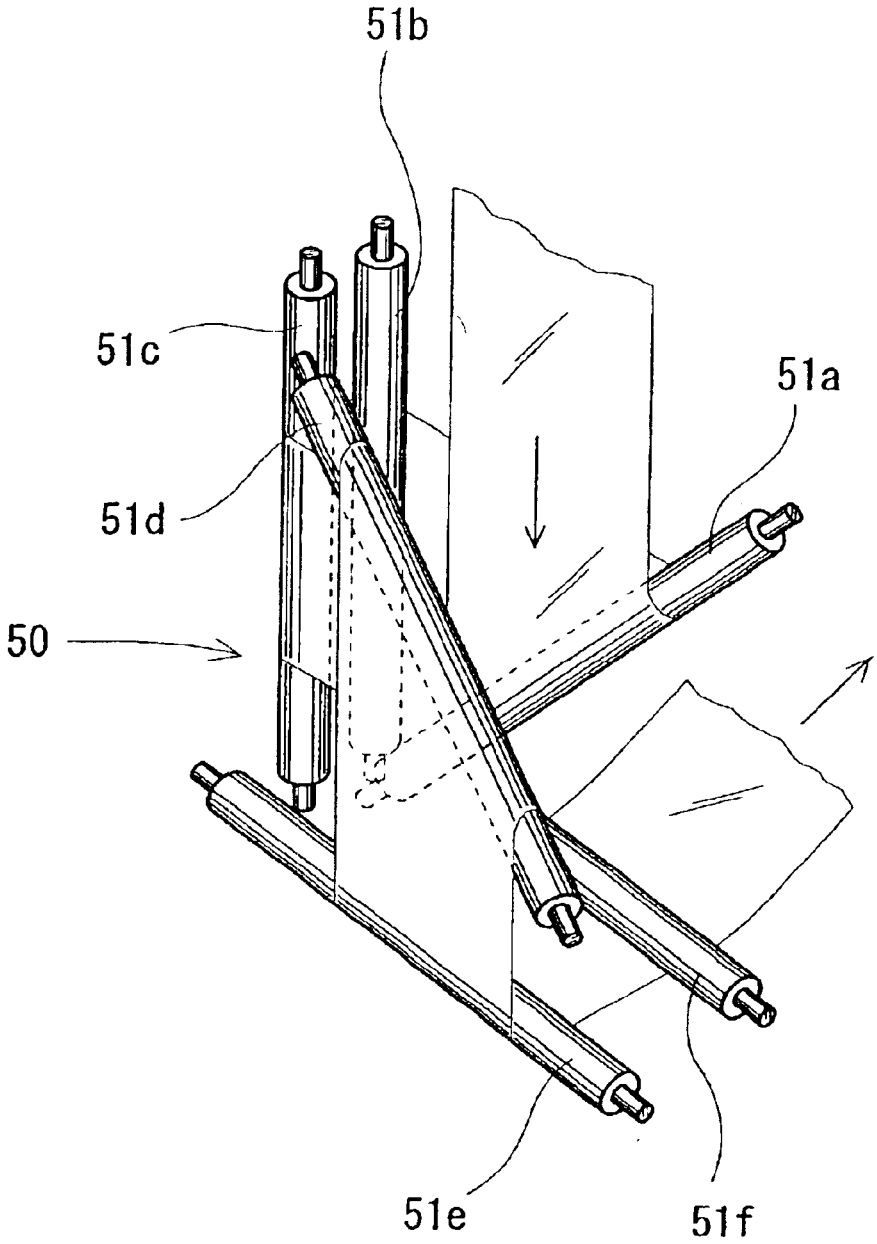
FIG. 2 is a perspective view of a film turning device of the form-fill sealing machine.

Referring to FIG. 2, the film turning device 50 may include first to sixth turning rollers 51*a* to 51*f*. The film F may be fed from the labeling device 40 downwardly toward the film turning device 50 and may be first engaged by the first turning roller 51*a*. The first turning roller 51*a* may be inclined at an angle of 45° relative to vertical direction, i.e., the feeding direction of the film F toward the first turning roller 51*a*. Therefore, the feeding direction of the film F may be changed by an angle of 90° by the first turning roller 51*a*, so that the film F may be transferred in the horizontal direction. The film F may then be in turn engaged by the second turning roller 51*b* and the third turning roller 51*c* that extend vertically in parallel to each other. The second and third rollers 51*b* and 51*c* may serve to turn back the feeding direction in an opposite direction. Then, the film F may be engaged by the fourth turning roller 51*d* that is inclined at an angle of 45° relative to the horizontal direction, i.e., feeding direction of the film F toward the fourth turning roller 51*d*. Therefore, the feeding direction may be again changed by an angle of 90°, so that the film F may be fed in the vertical direction. The film F may then be engaged by fifth turning roller 51*e* and the sixth turning roller 51*f* that extend horizontally in parallel to each other. Therefore, the film F may be reversed (or turned upside down), as the film F is fed through the first to sixth rollers 51*a* to 51*f* in this order. The film F may be fed from the sixth turning roller 51*f* toward the film feeding roller device 20 that is disposed on the right and upper side of the film turning device 50 as viewed in FIG. 2.

Referring again to FIG. 1, the film F that has been reversed by the film turning device 50 may be clamped between the pair of rollers of the film feeding device 20 and may be fed toward the downstream side as the rollers of the film feeding device 20 rotate. Preferably, the rotational speed of the rollers may be controlled to be varied in response to a vertical position of a tensioning roller 21 that is disposed on the downstream side in the feeding direction of the film feeding device 20.

The tensioning roller 21 may serve to always apply a predetermined tension in the downward direction to the film F that is continuously fed at a predetermined speed. More specifically, the tensioning roller 21 may be reciprocally moved vertically in response to the operation of a feeding belt device 63 that is intermittently driven in order to feed the tubular film T. Thus, as the tubular film T is moved by the feeding belt device 63 toward the downstream side, the tensioning roller 21 moves upward form a lowermost position to an uppermost position, so that the rollers of the film feeding device 20 rotate at a high speed. On the other hand, during the interruption of the feeding operation of the feeding belt device 63, the tensioning roller 21 moves downward from the uppermost position to the lowermost position, so that the feeding speed may be reduced to a predetermined speed. The tensioning roller 21 may be reciprocally vertically moved to apply the predetermined tensioning force to the film F.

The film F may be fed to the tube former 60 via guide rollers 22*a*, 22*b* and 22*c* that engage the film F.

The film F may be formed into the tubular film T by the tube former 60 and then be fed vertically downward along an outer wall of an article charging mandrel 72 that is inserted into the tube former 60 and extends coaxially with the tube former 60. Because the film F has been turned upside down at the film turning device 50 before reaching the tube former 60, the surface of the film F to which the re-stickable labels 103 have been stuck may define an outer surface of the tubular film T. During the interruption of the movement of the feeding belt device 63, the lengthwise sealing device 80 may clamp and seal the lapped edge of the tubular film T, which lapped edge extends in the lengthwise direction or the longitudinal direction of the tubular film T.

Preferably, a hopper 71 may be joined to the upper end of the mandrel 72. The articles to be charged into the tubular film T may be supplied into the hopper 71 via a combined measuring device or any other suitable supply device. The articles may then fall within the mandrel 72 by a gravity force so as to be suitably charged into the tubular film T.

The feeding belt device 63 may include a pair of feeding belts that are disposed on both sides of the mandrel 72. The feeding belts may serve to hold the tubular film T against the mandrel 72 and may be intermittently driven to feed the tubular film T in the downward direction. The crosswise sealing device 90 may be disposed below and adjacent to the lower end of the mandrel 72. The crosswise sealing device 90 may have heat sealing bars 91*a* and 91*b* that may serve to clamp the tubular film T by a predetermined pressure and to seal the tubular film T by heat during the time when the feeding operation of the tubular film T is interrupted. Therefore, a crosswise seal may be formed in the tubular film T at position adjacent to and above each article or each group of a predetermined number of articles. In addition, a cutter 92 may be disposed within the heat sealing bar 91*a* and may serve to cut tubular film T at the same time the crosswise seal is formed. Therefore, the tubular film T may be separated into a plurality of flexible pillow packages each containing a single article or a single group of articles and having crosswise sealed portions 109 (see FIGS. 3 to 5) on both sides in the lengthwise direction.

Figure 3:
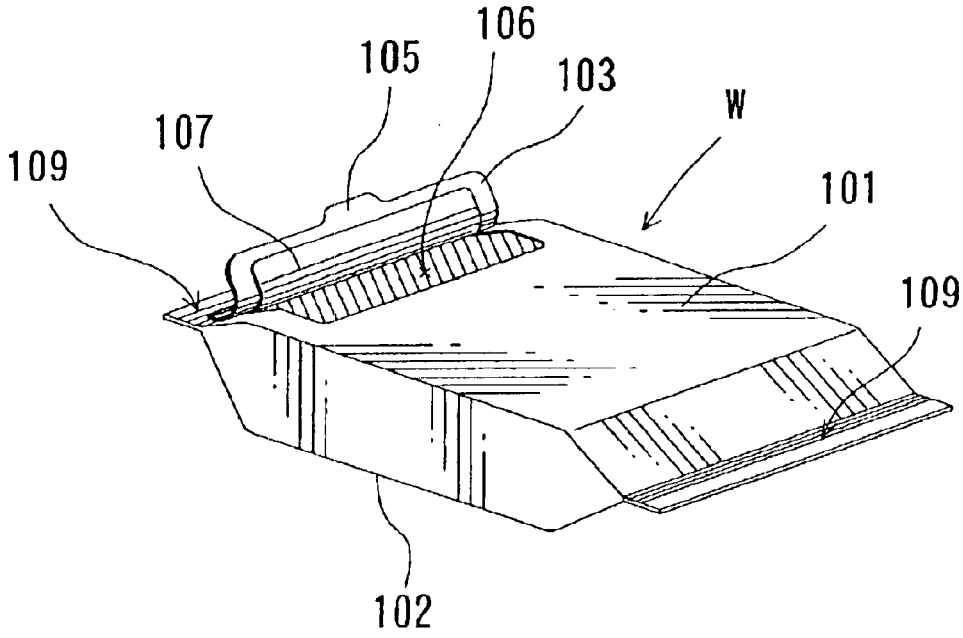
FIG. 3 is a perspective view of a representative package and showing the operation for unsealing the package.
Figure 4:
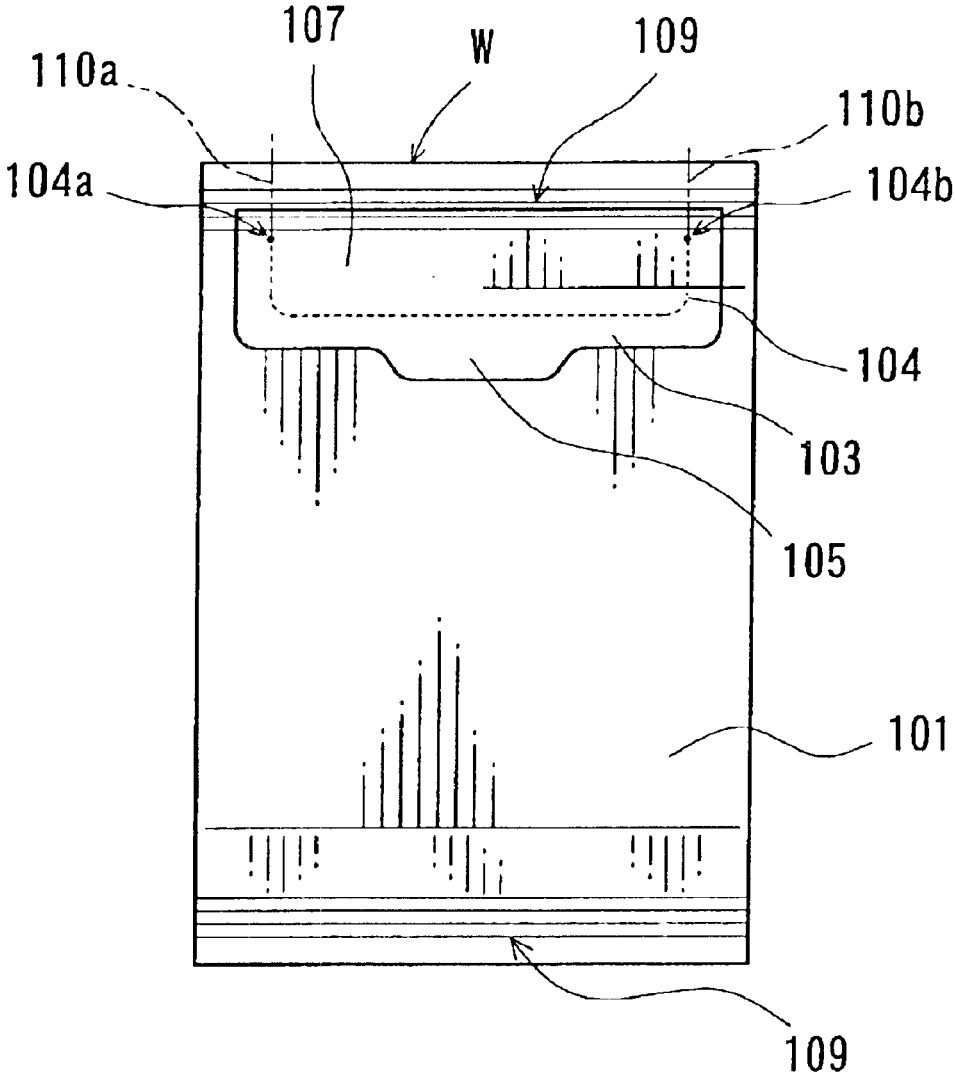
FIG. 4 is a plan view of the package.
Figure 5:
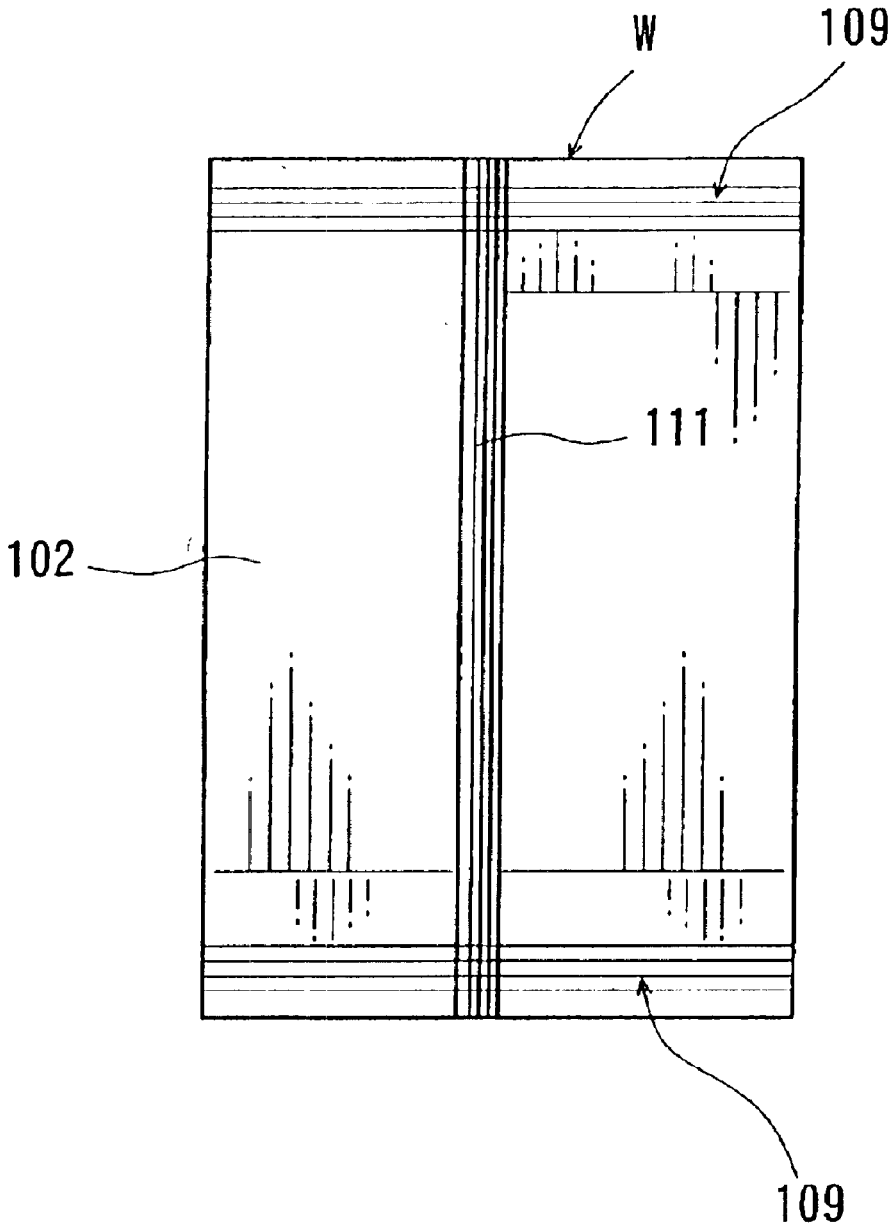
FIG. 5 is a bottom view of the package.

A representative flexible pillow package W that may be manufactured by the representative vertical form-fill sealing machine 1 will now be described with reference to FIGS. 3 to 5. The film F that is formed into the pillow package W may be made of heat sealable synthetic resin, e.g. polypropylene. The crosswise sealed portions 109 may be formed on both sides of the article or the group of articles in the lengthwise direction of the package W. As shown in FIG. 5, the lengthwise sealed portion 111 may be positioned on the side of a rear surface 102 of the package W and may extend perpendicular to the crosswise sealed portions 109. As shown in FIG. 4, the U-shaped tearable line 104 may be formed in a front surface 101 of the package W. The tearable line 104 may be covered by the re-stickable label 103.

Preferably, the label 103 may have a tab 105 that projects outward from the label 103. Therefore, in order to unseal the package W, the tab 105 may be pulled up, so that the label 103 can be easily peeled off from the front surface 101. To this end, no adhesive may be applied onto the rear surface of the tab 105. In other words, the rear surface of the tab 105 may not serve as an adhesive surface. Therefore, the unsealing operation can be easily performed.

An inner cover 107 may be defined by a portion of the front surface 101 that is surrounded by the tearable line 104 and stuck to the label 103. Therefore, as the label 103 is peeled off from the front surface 101 of the package W, the inner cover 107 may be forced to be pulled or lifted due to the adhesive force between the label 103 and the inner cover 107. As a result, the tearable line 104 may be torn and the inner cover 107 may be pulled out from the front surface 101, so that a take-out opening 106 having a substantially U-shaped open edge may be formed in the front surface 101. Therefore, the article or the articles contained in the package W can be taken out from the take-out opening 106.

As described previously, the tearable line 104 may be a perforated line or a half tearable line. Here, the term "perforated line" is used to mean a series of perforations, so that no perforated portion is defined between two adjacent perforations. The term "half tearable line" is used to mean a continuous tearable line that does not extend throughout the thickness of the film F.

As shown in FIG. 4, both ends 104*a* and 104*b* of the tearable line 104 may terminate at a position adjacent to the crosswise sealed portion 109. In other words, the crosswise sealed portion 109 may be positioned on virtual lines 110*a* and 110*b* that are extended from the ends 104*a* and 104*b*, respectively. Therefore, even in the event that the inner cover 107 has been pulled upward by a relatively strong force as the label 103 is pulled upward to be peeled off from the front surface 101, the propagation of tearing of the film F beyond the ends 104*a* and 104*b* may be reliably and effectively prevented by the crosswise sealed portion 109. Because the crosswise sealed portion 109 is formed by heating and melting the lapped film portions, the crosswise sealed portion 109 may provide a reliable resistance against the tearing.

In addition, the crosswise sealed portion 109 of the representative pillow package W may extend linearly and may intersect perpendicularly to the virtual lines 110*a* and 110*b* that are extended from the ends 104*a* and 104*b*, respectively. Therefore, even in the event that the film F has occasionally been torn beyond the ends 104*a* and 104*b* of the tearable line 104 due to a strong pulling force applied to the inner cover 107, the propagation of the tearing may be stopped at the crosswise sealed portion 109 when the tearing propagates by a short distance beyond the ends 104*a* and 104*b*. Therefore, the propagation of tearing of the film F beyond the ends 104*a* and 104*b* may be minimized. Further, if the label 103 is designed to have a size that may cover a possible tearing propagation area beyond the ends 104*a* and 104*b* of the tearable line 104, the necessary size of the label 103 may be minimized. As a result, the material cost of the package W can be reduced.

Furthermore, the label 103 that is stuck onto the front surface 101 to cover the tearable line 104 of the representative package W may be arranged such that one end of the label 103 opposite to the tab 105 extends over a part of the crosswise sealed portion 109. As described previously, the tab 105 may be lifted in order to peel off the label 103 from the front surface 101. Therefore, the one end of the label 103 opposite to the tab 105 may be stuck onto the part of the crosswise sealed portion 109. With this arrangement, the label 103 can cover the tearable line 104 while the label 103 reliably covers a possible tearing propagation area beyond the ends 104*a* and 104*b* of the tearable line 104. Therefore, even in the event that the label 103 has been pulled by a strong force in order to unseal the package W, the tearable line 104 will not extend beyond the area that is covered by the label 103. As a result, the sealing property of the package W can be ensured even if the label 103 has been repeatedly used to reseal the package W.

Furthermore, the take-out opening 106 that may be defined after the unsealing operation may be positioned adjacent to the crosswise sealed portion 109 that defines a first end of the package W. Therefore, if the package W contains a plurality of separate articles, the articles may be easily taken out or discharged from the take-out opening 106 by positioning a second end of the package W upward relative to the first end.

Furthermore, the backside surface of the label 103 that opposes to the tubular film T during the sealing operation by the crosswise sealer 90, in particular at least a part of the backside surface of the label 103 that opposes to the heat sealing bar 91*a* or 91*b* so as to be clamped between the heat sealing bars 91*a* and 91*b* may be treated or coated with a material that can be melted by heat. Therefore, this part of the backside surface of the label 103 may be fused to be adhered to the crosswise sealed portion 109 at the same time that the crosswise sealed portion 109 is formed. As a result, a portion of the label 103 on the side opposite to the tab 105 may be reliably fixed to the front surface 101 of the package W at the crosswise sealed portion 109. This may be advantageous because the label 103 may be reliably prevented from being removed from the package W during the transportation. In addition, it is not necessary to set the position of the label 103 when the label 103 is required to be stuck again in order to reseal the take-out opening 106 of the package W. Therefore, the package W can be conveniently used. Of course, the label 103 itself may be made of material that can be melted by heat.

Even in case that the label 103 is not treated or coated with such a material that can be melted by heat, a part of the label 103 that is clamped between the heat sealing bars 91*a* and 91*b* may be closely stuck onto the front surface 101 of the package W at the crosswise sealed portion 109. Therefore, the sealing property of the package W given by the label 103 may be improved.

Figure 6:
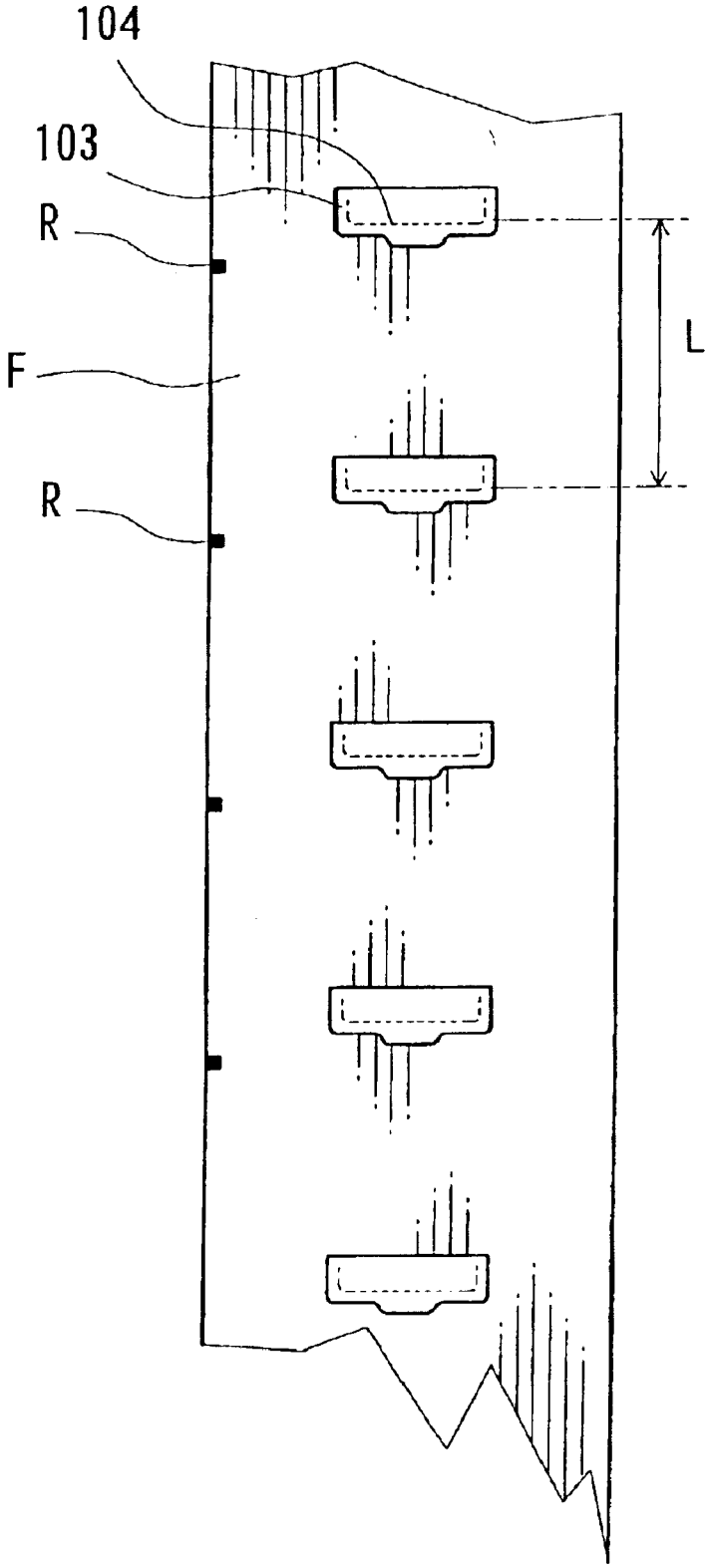
FIG. 6 is a plan view of a web-like film and showing the tearable lines formed therein and re-stickable labels stuck to cover the tearable lines.

The operation of the various elements of the representative vertical form-fill sealing machine 1 during manufacturing the representative packages W will now be described with reference to FIGS. 1 and 6.

First, the substantially U-shaped tearable lines 104 may be formed in the web-like film F by the tearable line forming device 30. The tearable line forming device 30 may be controlled such that the tearable lines 104 are spaced from each other in the lengthwise direction of the film F by a distance L that corresponds to a length of a single package W. In addition, the direction of the tearable lines 104 may be determined such that the direction for peeling off the inner covers 107 defined by the tearable lines 104 is the same as the feeding direction of the film F.

Then, the re-stickable labels 103 may be stuck onto the film F by the labeling device 40 in order to cover the respective tearable lines 104. The labeling device 40 may be controlled such that the labels 103 may be stuck onto the film F in positions that correspond to the positions of the tearable lines 104.

Preferably, figures or patterns may be printed onto the film F and each figure or pattern may be determined to correspond to each package W. Therefore, each tearable line 104 may be formed to be positioned at predetermined position relative to each figure or pattern. Each label 103 may be positioned to cover each tearable line 104 as described above. In this connection, the crosswise sealing device 90 for forming the crosswise sealing portions 109 on the tubular film T may be controlled such that each crosswise sealing portion 109 overlaps with the fixed side end portion of each label 103. As a result, the representative package W can be continuously manufactured.

A representative method for controlling various elements of the representative vertical form-fill sealing machine 1 during the manufacturie of the representative packages W will now be described.

Referring to FIG. 1, a mark sensor S1 may be disposed along the feeding path of the film F within the tearable line forming device 30. The mark sensor S1 may serve to detect registration marks R that may be printed on the film F at regular intervals along one lateral edge of the film F (see FIG. 6). More specifically, the mark sensor S1 may detect the registration marks R when the film F is fed vertically upward between the fixed pulleys 33*c* and 33*d*. The sensor S1 may be disposed at any other position along the feeding path of the film F. Otherwise, the sensor S1 may be replaced by a mark sensor S2 that is disposed along the feeding path of the film F between the film feeding device 20 and the tube former 60.

When the registration marks R are detected by the sensor S1, the sensor S1 may output detection signals to a controller (not shown).

A feeding amount detection device 43 may be disposed in a position adjacent to a direction-turning position of the release paper P at the labeling device 40. The feeding amount detection device 43 may include a pair of rollers and the film F may pass between these rollers. An encoder RE1 may be coupled to a rotary shaft of one of the rollers of the feeding amount detection device 43, so that the rotational speed of the rollers may be converted into electric signals by the encoder RE1. The electric signals may then be transmitted to the controller, so that the controller calculates the feeding amount of the film F based on the electric signals. Then, the feeding position of the film F may be determined with reference to the registration marks R. Therefore, the knife 31 may be operated each time when the film F reaches a predetermined position, and each tearable line 104 may be formed in a predetermined position relative to each figure or pattern printed on the film so as to correspond to each package length.

After the tearable lines 104 have been formed in the film F, the labeling device 40 may be operated each time when the feeding amount of the film F has reached to a predetermined amount, so that the labels 103 may be stuck onto the film F to cover the respective tearable lines 104. In this way, the detection signals of the registration marks R detected by the mark sensor S1 and the electric signals from the encoder RE1 coupled to the rotary shaft of the feeding amount detection device 43 also may be used for determining the time when each tearable line 104 has reacted to a position for sticking each label 103 based on the the time when the feeding amount of the film F has reached to the predetermined amount.

After the labels 103 have been stuck, the film F may be turned upside down by the film turning device 50 and then may be fed in a direction toward the downstream side by the film feeding device 20. The film F may then be fed to the tube former 60 via the tensioning roller 21. The mark sensor S2 may be disposed along the feeding path of the film F between the tensioning roller 21 and the tube former 60. More specifically, during the feeding operation of the film F between guide rollers 22*a* and 22*b* that extend horizontally in parallel to each other, the mark sensor S2 may detect the registration marks R printed on the film F. Therefore, the feeding position of the film F on the downstream side of the tension roller 21 may be determined with reference to the detection signals from the mark sensor S2.

The film F may be converted into the tubular film T by the tube former 60 and may be fed vertically downward from the tube former 60. A surface of the tubular film T on the side opposite to the lengthwise sealing device 80 may be defined as the front surface 101 of each package W to be obtained. The labels 103 may be stuck onto the surface of the tubular film T to be defined as the front surface 101. In particular, the labels 103 may be stuck in positions, where the crosswise seals may be formed. In addition, the labels 103 may be spaced from each other by a distance corresponding to a single package length.

The tubular film T may then be downwardly intermittently fed by the feeding belt device 63, while the articles to be charged may be supplied into the tubular film T by a gravity force from the supply device.

The feeding belts of the feeding belt device 63 may be intermittently driven by a servo motor (not shown). The movement of the feeding belts may be interrupted each time when the film feeding position reaches to a predetermined position. The film feeding position may be determined based on the detection signals of the registration marks R from the mark sensor S2 and signals from an encoder that may be coupled to the servo motor.

In synchronism with the interruption of the movement of the conveying belts of the feeding belt device 63, the lengthwise sealing device 80 may operate to seal by heat the lapped edge portions of the tubular film T. In addition, the crosswise sealing device 90 may seal by heat and cut the tubular film T by the cutter 92 at each position above the article or the group of articles charged into the tubular film T.

As a result, a plurality of resealable flexible packages W can be continuously manufactured and each package W may have the crosswise sealing portions 109 formed in positions corresponding to upper and lower ends of the respective figures or patterns printed on the film F. In addition, the fixed side end of the label 103 may extend over one of the crosswise sealing portions 109 of each package W. Further, the ends 104*a* and 104*b* of the tearable line 104*b* may be positioned adjacent to one of the crosswise sealing portions 109.

The above representative vertical form-fill sealing machine, the representative package and the representative methods for manufacturing the packages and controlling various elements of the form-fill sealing machine may be modified in various ways.

For example, although the feeding belt device 63 in the above representative embodiment intermittently feeds the tubular film T, the film F and the tubular film T may be fed continuously in synchronism with each other. Otherwise, the film F and the tubular film T may be intermittently transferred in synchronism with each other.

In addition, although the film F is fed in the direction toward the downstream side by the film feeding device 20 in the above representative embodiment, the roller 10 may be rotatably driven to feed the film F. In addition, any other film feeding device may be used for feeding the film F.

Further, in the above representative embodiment, the knife 31 and the anvil 32 are intermittently operated and the tearable lines 104 are formed when the movement of the film F is temporarily stopped. However, the tearable lines 104 may be formed in the film F that is continuously transferred, while the knife 31 may be rotatably driven to form the tearable lines 104.

Furthermore, in the above representative embodiment, the labeling device 40 is constructed to stick the labels 103 to the film F, while the release paper P is continuously transferred at a speed corresponding to the feeding speed of the film F. However, if the film F is intermittently fed to the labeling device 40, the labels 103 may be stuck each time when the film F is stopped. In such a case, the feeding amount of the film F that corresponds to a single package length can be detected by an encoder or like device that is coupled to the servo motor for driving the feeding belt device 63.

Furthermore, in the above representative embodiment, the film F has figures or pictures printed thereon, the film F may be a plain film that has no figure or picture. In such a case, the registration marks R and the mark sensors S1 and S2 will not be required, because it is not necessary to consider the positioning of figures or pictures. However, it may still be necessary to position the tearable lines 104, the labels 103 and the crosswise sealed portions 109 relative to each other. To this end, the feeding amount corresponding to a single package length may be calculated based on the signals from the encoder RE1 coupled to the feeding amount detection device 43. Then, the operation timing of the tearable line forming device 30 and the distance between two adjacent labels 103 to be stuck onto the film F by the labeling device 40 may be adjusted to correspond to the single package length based on the calculated feeding amount.

Furthermore, in the above representative embodiment, the encoder RE1 is coupled to one of the rollers of the feeding amount detection device 43 and the rollers engage or contact the surface of the film F in order to detect the feeding amount of the film F. However, in order to determine the feeding amount of the film F, an encoder may be coupled to one of the rollers of the film feeding device 20 or may be coupled to a motor that drives the rollers of the film feeding device 20. Therefore, the feeding amount of the film F may be calculated based on the signals from the encoder. Otherwise, an encoder may be coupled to the rotary shaft of the roller 10 of the film or may be coupled to a motor that drives the rotary shaft if the roller 10 is rotatably driven by the motor. Thus, in order to obtain signals that represent the feeding amount of the film F(T), an encoder or any other suitable device can be used as long as it can directly or indirectly measure the feeding amount during the feeding operation of the film F (T).

Furthermore, the representative embodiment has been described in connection with the vertical form-fill sealing machine 1, through which the tubular film T is fed vertically downward. However, the present invention also may be applied to horizontal form-fill sealing machines, through which a tubular film is fed horizontally.

Furthermore, in the above representative embodiment, the tension roller 21 is disposed on the feeding path of the film F and two mark sensors S1 and S2 are disposed on the upstream side and the downstream side of the tension roller 21, respectively. However, one of the mark sensors S1 and S2 may be omitted if the tension roller 21 is not required.

What is claimed is:

1. A form-fill sealing machine for manufacturing resealable flexible packages, wherein each package includes a package body, a tearable line defined in the package body, an inner cover surrounded by the tearable line, and a re-stickable label attached to the package body in order to cover the tearable line, and when the label is peeled off, the inner cover is adapted to be pulled toward outside of the package, so that a take-out opening is formed in the package body, while a first end of the inner cover remains to be stuck onto the package body, comprising:

film feeding means arranged and constructed to feed a film from a roll of the film;

tearable line forming means arranged and constructed to form the tearable line in the film each time when the film is fed by the film feeding means by a distance that corresponds to a single package length, wherein the tearable line is configured such that the pulling direction of the inner cover becomes the same as the feeding direction of the film;

labeling means arranged and constructed to stick the label onto the film so as to cover each tearable line formed therein;

tube forming means arranged and constructed to form the film with the labels stuck thereto into a tubular film;

lengthwise sealing means arranged and constructed to seal lapped edges of the tubular film so as to form a lengthwise sealed portion, wherein the lengthwise sealed portion extends along a lengthwise direction of the tubular film; and crosswise sealing means arranged and constructed to seal the tubular film to form first and second crosswise sealed portions for each package, wherein the first and second crosswise sealed portions extend along a crosswise direction at forward and rearward positions of an article or a group of articles that are charged into the tubular film, and the first crosswise sealed portion extends across the first end of each label in a position adjacent to or intersecting with both ends of each tearable line;

wherein the crosswise sealing means is further arranged and constructed to clamp the first end of each label together with the tubular film in order to form the first crosswise sealed portion, so that the first end of the label is fixedly attached to the first crosswise sealed portion, and cutting means arranged and constructed to cut the tubular film with first and second sealed portions and the labels into separate packages, so that each package has a first edge on the side of the first crosswise sealed portion having the label attached thereto and a second edge on the side of the second crosswise sealed portion, wherein the first edge of each package is spaced from the first end of the label.

2. A form-fill sealing machine as in claim 1, wherein the first crosswise sealed portion is disposed adjacent to both ends of each tearable line, so that virtual lines extending from both ends of each tearable line intersect with the first crosswise sealed portion.

3. A form-fill sealing machine as in claim 1, wherein:

the form-fill sealing machine comprises a vertical form-fill sealing machine, in which the tubular film is fed vertically downward and the article or the articles supplied into the tubular film fall downward within the tubular film, the labeling means is disposed on the upper side of the feeding path of the film, the form-fill sealing machine further includes a film turning means that is disposed along the feeding path of the film between a film sticking position for sticking the labels by the labeling means and the tube forming means, and the film turning means is arranged and constructed to turn the film upside down.

4. A form-fill machine as in claim 1, further including:

a mark sensor arranged and constructed to detect registration marks affixed to the film, and signal generating means for generating signals representing a film feeding amount corresponding to the feeding amount of the film, and wherein the feeding position of the film is recognized based on signals from the mark sensor and the signal generating means, so that the position of each tearable line can be determined.

5. A form-fill sealing machine for manufacturing resealable packages, comprising:

a tearable line forming device arranged and constructed to form tearable lines in flexible film, wherein the tearable lines are spaced from each other by a distance corresponding to a single package length in a longitudinal direction of the film, and each tearable line has two ends;

a labeling device arranged and constructed to stick restickable labels onto the film in positions to cover the respective tearable lines;

wherein each label includes a first end and a second end opposing to the first end in the peeling direction of the label, and wherein the second end is adapted to be lifted in order to peel off the label;

a tube forming device arranged and constructed to form the film into a tubular film;

a first sealing device arranged and constructed to seal lapped edges of the tubular film so as to form a lengthwise sealed portion, wherein the lengthwise sealed portion extends along a lengthwise direction of the tubular film;

a second sealing device arranged and constructed to seal the tubular film in a crosswise direction, so that crosswise sealed portions are formed on the tubular film and are spaced from each other in the longitudinal direction of the tubular film, wherein each tearable line is positioned between two adjacent crosswise sealed portions, the ends of each tearable line are disposed adjacent to or intersect one of the two adjacent crosswise sealed portions; and wherein the second sealing device is further arranged and constructed to clamp the first end of each label together with the tubular film in order to form the crosswise sealed portion, so that the first end of each label is fixedly attached to the crosswise sealed portion; and a cutting device arranged and constructed to cut the tubular film in a direction substantially perpendicular to the longitudinal direction of the tubular film at each crosswise sealed portion in a position spaced from the first end of the label, so that each crosswise sealed portion is divided into a front end of one of each two adjacent packages and a rear end of the other of each two adjacent packages, and wherein the first end of the label is fixedly attached to the front end of each package while the first end of the label is spaced from a cut edge of the front end of each package.

6. A form-fill sealing machine as in claim 5, wherein the cutting device is arranged and constructed to cut each crosswise sealed portion at the same time that each crosswise sealed portion is formed.

7. A form-fill sealing machine as in claim 5, wherein each crosswise sealed portion is disposed such that virtual lines extended from both ends of each tearable line intersect with each crosswise sealed portion.

8. A form-fill sealing machine as in claim 5, wherein the second sealing device comprises a heat sealing device, and at least a part of each label opposing to each crosswise sealed portion is made of material that is melted by heat applied from the heat sealing device so as to be attached to the tubular film.

9. A form-fill sealing machine as in claim 5, wherein:

the form-fill sealing machine comprises a vertical form-fill machine, in which the tubular film is fed vertically downward and the article or the articles supplied into the tubular film fall downward within the tubular film, the labeling device is disposed on the upper side of the feeding path of the film prior to the formation into the tubular film, and the form-fill sealing machine further includes a film turning device that is disposed along the feeding path of the film between the labeling device and the tube forming device, so that the film is turned upside down after the labels have been stuck onto the film.

10. A form-fill sealing machine as in claim 5, further including:

a mark sensor arranged and constructed to detect registration marks affixed to the film, and a signal generating device for generating signals representing a feeding amount of the film, and wherein the feeding position of the film is recognized based on signals from the mark sensor and the signal generating device, so that the position of each tearable line can be determined.

11. A machine comprising:

means for forming an unfinished flexible package from a film, wherein the unfinished package includes a tearable line formed therein, and the tearable line has a substantially U-shaped configuration and has two ends;

means for sticking a label on the unfinished package to cover the tearable line, wherein the label includes a first end and a second end opposing to the first end in the peeling direction of the label, and wherein the second end is adapted to be lifted in order to peel off the label; and means for heat sealing at least the film of the unfinished package in a position adjacent to or intersecting with the ends of the tearable line with the first end of the label clamped together with the film so as to form a finished package having a sealed portion such that the first end of the label is fixedly attached onto the sealed portion simultaneously with the formation of the sealed portion, and wherein the first end of the label is spaced from an edge of the finished package positioned on the same side as the first end of the label.

12. A machine as in claim 11, wherein the unfinished package has a tubular configuration and has a first and second open ends opposite to each other, and wherein the heat sealing means is arranged and constructed to clamp and heat the first open end and a part of the label.

13. A machine as in claim 12, wherein the label is fused to be attached to the unfinished package by the heat sealing means.

14. A method of manufacturing a plurality of resealable flexible packages from a film, comprising:

forming a plurality of tearable lines in the film, wherein the tearable lines are spaced from each other by a distance corresponding to a single package length in a longitudinal direction of the film, wherein each of the tearable lines has first and second ends;

sticking a plurality of restickable labels onto one surface of the film to cover the respective tearable lines;

forming the film into a tubular film, wherein the labels are positioned on the outer side of the tubular film;

sealing lapped edges of the tubular film, wherein the lapped edges extend in the longitudinal direction of the tubular film;

clamping and sealing the tubular film in a crosswise direction at intervals corresponding to the intervals of the tearable lines with a part of each label clamped together with the tubular film, so that crosswise sealed portions are formed on the tubular film while the part of each label is fixedly attached to the tubular film simultaneously with the formation of each sealed portion; and cutting the tubular film at each of the crosswise sealed portions in a position spaced from the part of each label attached to the tubular film, so that a plurality of packages each having first and second sealed ends defined by the crosswise sealed portions are formed, wherein the part of the label is positioned adjacent to and spaced from an edge of the first sealed end of each package, and wherein the first and second ends of each tearable line are positioned adjacent to and intersect with the first sealed end.

15. A method as in claim 14, wherein the step of sealing the tubular film in the crosswise direction and the step of cutting the tubular film are performed simultaneously with each other.

16. A method as in claim 14, wherein the step of sealing the tubular film in the crosswise direction comprising clamping the tubular film by sealing members and applying heat to the tubular film via the sealing members.

17. A method as in claim 14, further including fusing apart of each label so as to attached to the tubular film.

18. A method as in claim 17, wherein the step of fusing the part of each label is performed simultaneously with sealing the film to form each crosswise sealing portion.

19. A method as in claim 14, further including supplying an article into the tubular film at each time after the sealing portion has been formed.

* * * * *